US005620381A

United States Patent [19]

Spalding

[11] Patent Number: 5,620,381

[45] Date of Patent: Apr. 15, 1997

[54] GOLF PUTTER

[75] Inventor: George T. Spalding, Bradenton, Fla.

[73] Assignee: George Spalding, Inc., Monroe City, Mo.

[21] Appl. No.: 624,995

[22] Filed: Mar. 29, 1996

[51] Int. Cl.[6] ..... A63B 53/04

[52] U.S. Cl. ..... 473/329; 473/330; 473/342

[58] Field of Search ..... 473/235, 329, 473/330, 332, 342, DIG. 30, 236

[56] References Cited

U.S. PATENT DOCUMENTS

| | | | |
|---|---|---|---|
| 2,445,718 | 7/1948 | Sternberg et al. | 273/167 B |
| 3,895,797 | 7/1975 | Moore | 273/DIG. 30 |
| 4,826,173 | 5/1989 | Brown | 473/235 |
| 5,083,778 | 1/1992 | Douglass | 273/78 |
| 5,316,304 | 5/1994 | Yost | 273/168 |
| 5,348,301 | 9/1994 | Ma | 273/167 B |
| 5,458,332 | 10/1995 | Fisher | 273/78 |
| 5,464,212 | 11/1995 | Cook | 273/78 |
| 5,467,987 | 11/1995 | Perkins et al. | 273/175 |

FOREIGN PATENT DOCUMENTS

| | | | |
|---|---|---|---|
| 1192139 | 5/1970 | United Kingdom | 273/78 |

OTHER PUBLICATIONS

Front cover only of French patent document dated 1933. 273–167J.

Sales literature published in Golf World for "Pulse Putter", dated Jul. 1, 1977.

*Primary Examiner*—George J. Marlo

*Attorney, Agent, or Firm*—Litman, McMahon and Brown, L.L.C.

[57] ABSTRACT

An improved golf putter includes a putting face with a plurality of fine spring wires extending outward therefrom. Each of the spring wires includes a substantially horizontal initial leg portion extending outward form the putter face and an angled leg portion which extends upward and outward away from the initial leg portion. As the putter is swung, the angled leg portions spring inward and then upward and outward due to contact with the golf ball. This spring action simultaneously imparts both a forward and a topspin motion to the golf ball. The wires can be attached to an insert which is replaceable and interchangeable. Inserts with wires extending at differing angles can be provided to counteract a player's tendency to close or open the putter face during a putting stroke. A protective molding can be provided for surrounding and protecting the spring wires.

24 Claims, 2 Drawing Sheets

Fig. 1.
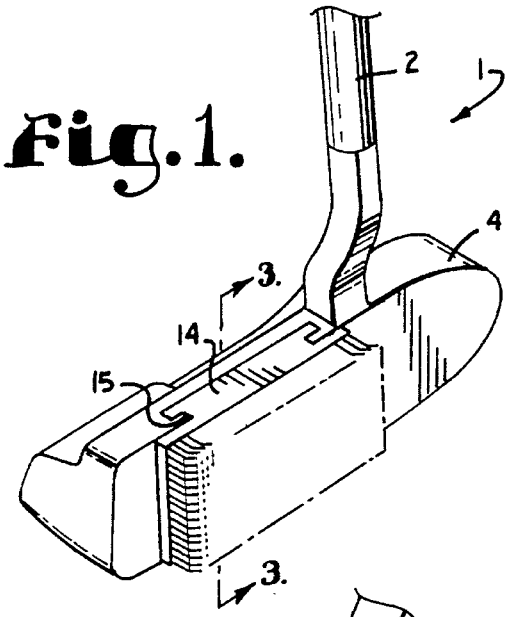
Fig. 2.
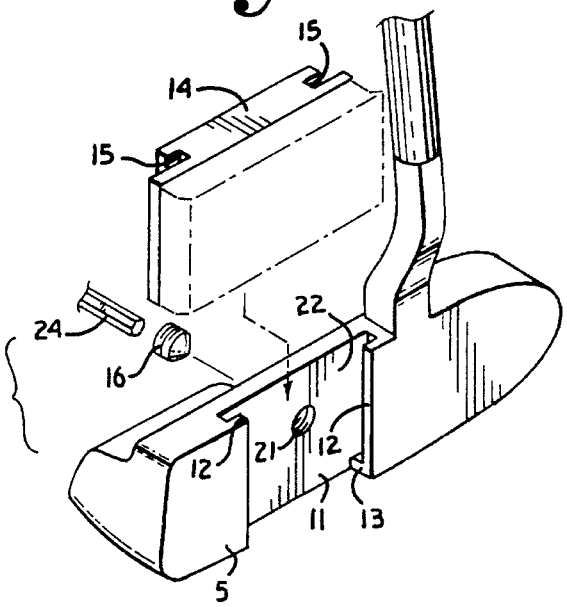
Fig. 3.
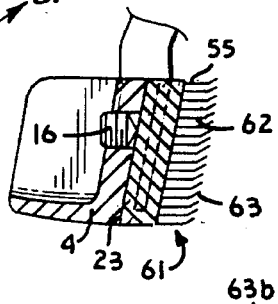
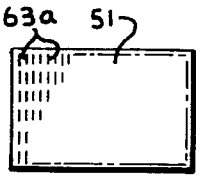
Fig. 4a.
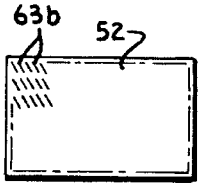
Fig. 4b.
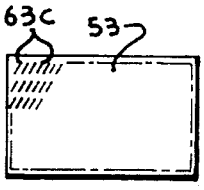
Fig. 4c.
Fig. 5.
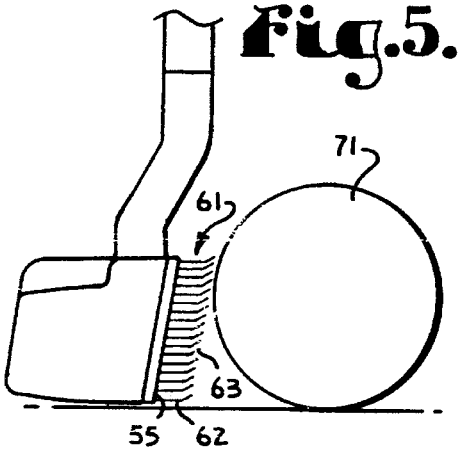
Fig. 6.
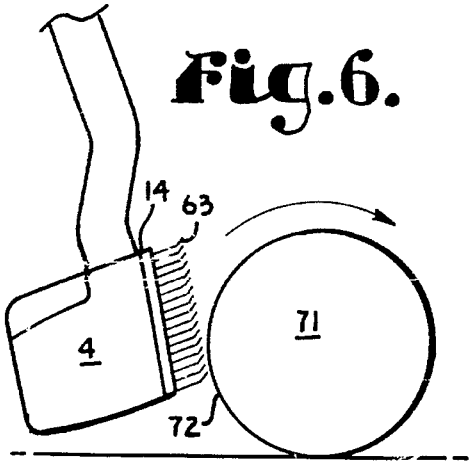

Fig.7.
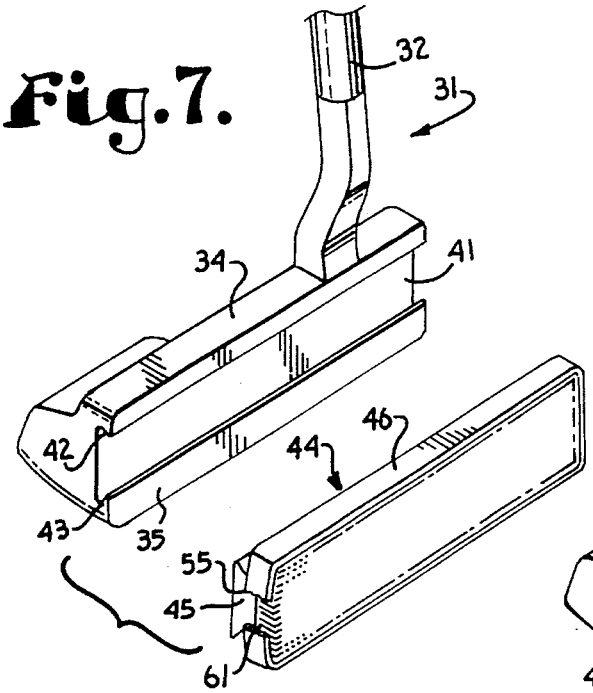
Fig.8.
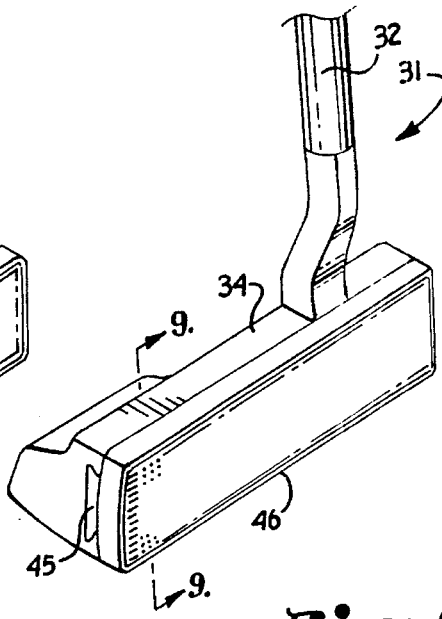
Fig.9.
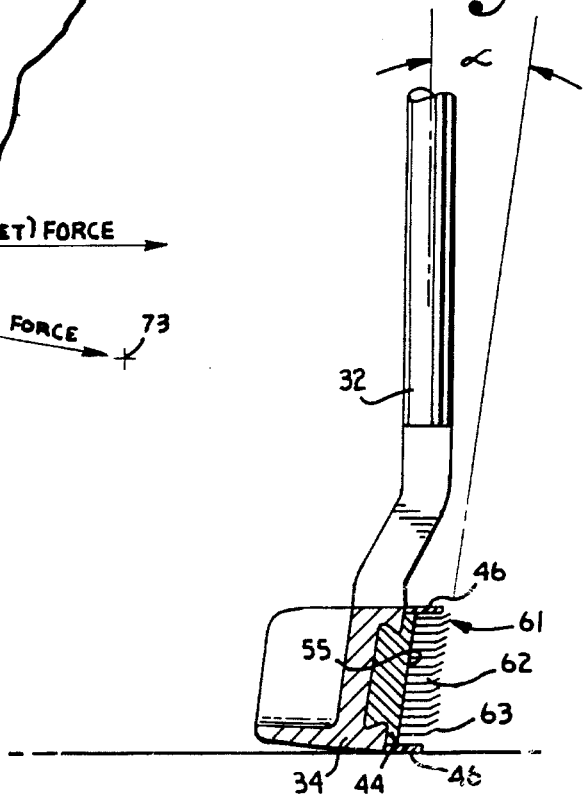
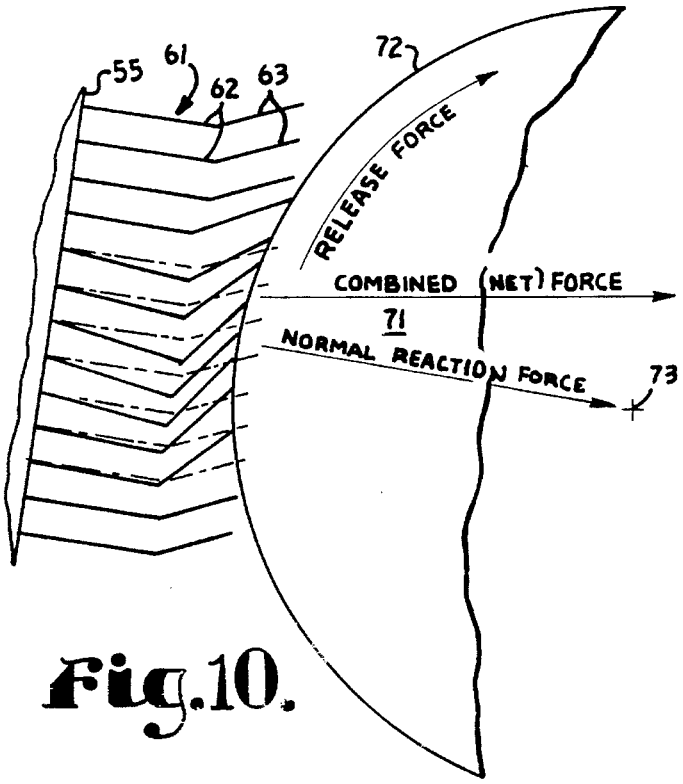
Fig.10.

GOLF PUTTER

BACKGROUND OF THE INVENTION

1. Field of the Invention

The present invention relates generally to an improved golf putter, and, more particularly to such a putter with a face including a plurality of spring wires which tend to impart topspin to a golf ball as it is struck.

2. Description of the Related Art

Accurate putting is essential to achieve a low golf score. In an eighteen hole round the number of regulation putts is two per hole or thirty-six, which equals one-half of a typical par score of seventy-two. If a golfer can lower his average number of putts to 1.5 per hole, he or she can pick up nine strokes on par during this phase of the game.

Since golf was invented, numerous attempts have been made to create an improved putter. Originally putters were simply a flat blade head attached to a shaft with the head having a smooth putting face. In an effort to improve putting accuracy, putters have been changed in many ways. For example, putter faces have been widened to expand the "sweet spot" of the putter, the sweet spot has been marked in various ways, such as with a different color or with directional arrows, and heads have been made hollow or partially hollow to make them more resilient and/or to create a specific sound when the ball is struck. Putter shafts have been lengthened, shortened, stiffened or made more resilient.

There seems to be a consistent opinion of many golf instructors and pros that it is important to get a golf ball "rolling" as early in the putting stroke as is possible. This is as opposed to scooting the ball over the putting surface. Accordingly, such teachers of putting techniques have emphasized that a golfer should use a smooth stroke with follow through after the putter contacts the ball to maximize putter contact with the ball. The theory is that this technique both aids in aligning the club and the desired ball path, but also that the ball will start rolling sooner with such a stroke. When a golf ball is rolling rather than scooting over the putting surface, the ball will have less of a tendency to follow the "grain" of the grass on the putting green and, instead, the inertia of a rolling ball will cause it to have more of a tendency to continue in the true direction of the putting stroke. Furthermore, a rolling golf ball will be deflected less by small imperfections such as ball and cleat marks in the putting surface than a ball which is scooting.

Some inventors have altered putters in an attempt to use the putter face as an aid in imparting forward roll or topspin to a golf ball. One example is reflected in the disclosure of U.S. Pat. No. 2,445,718 to Sternberg et al., which teaches a putter with a face roughened by horizontal scores to provide "over spin" on the ball. Another example is U.S. Pat. No. 5,348,301 to Ma which teaches a putter with a face slanted away from the ball as it is addressed. The face also has a number of lateral grooves which are said to "increase the force of rotation of the ball" as the stroke proceeds.

While both the Sternberg et al. and the Ma patents are concerned with imparting an over spin or topspin to the golf ball as it is struck, they are of limited effectiveness. In each case, the putter face is solid, i.e. does not yield perceptibly upon impact of the club face with the ball. With such a construction, the golf ball immediately rebounds off of the putter face as it is struck. Thus, any topspin imparted by the club face will be minimal since the time during which the club face actually contacts the ball is very short. In fact, Ma describes a goal of his invention as "minimizing the contact time of the ball with the hitting portion of the putter head".

Furthermore, any topspin imparted by the Sternberg or Ma putters is in a direction perpendicular to the club face. Since many amateur golfers have a tendency to either pull a putter to the inside of the true path or push it to the outside of the true path, or, alternatively, to close or open the putter club face during the putting stroke, it would be advantageous if a putter could be designed to help offset these tendencies.

Accordingly, it is clear that a need exists for an improved golf putter which imparts a pronounced topspin to a golf ball as it is struck. Furthermore, such a putter should preferably be capable of counteracting a tendency of a golfer to either push or pull his putting stroke, or, alternatively, to counteract the effects of a closed or open putter face.

SUMMARY OF THE INVENTION

In the practice of the present invention, an improved golf putter includes a putter head with a plurality of rows of small diameter spring wires, each of which includes a first leg portion which protrudes a short distance horizontally out from the front surface of the putter head and connects with a second, angled leg portion which is bent at an angle upward. The spring wires thus resemble a wool card. The angled portion of the wires can extend in a plane perpendicular to the front face of the putter head, or, in order to compensate for the tendency of a golfer to open or close the putter thee during the putting stroke, the spring wires can extend at an angle either to the left of or to the right of the perpendicular plane, respectively. The spring wires, since they are resilient, tend to flex inward at contact with a golf ball and then rebound outward, thus maximizing contact time between the putter face and the ball during a putting stroke. In addition, the rebound effect of the angled spring wires tends to impart a topspin motion to a golf ball as the wires push outward and upward on the ball periphery. The spring wires also tend to counteract a putting stroke which is pulled inside of, or pushed outside of the true path to the target. This effect is seemingly due to a channeling effect provided by the spring wires immediately surrounding the point of impact on the ball which causes the ball to be propelled in a direction perpendicular to the putter thee regardless of the swing path. In order to counteract a player's tendency to close or open the putter thee during the stroke, the angled leg portions can be angled right or left, respectively, to thereby impart a side vector to the topspin motion of the ball.

The putter head incorporates a slot which accommodates a removable insert. The insert includes a planar surface with the spring wires attached thereto. The inserts can thus be removed and replaced when they are worn out, and/or the putter can be customized with different inserts for different golfers. To adequately secure the insert, in a first embodiment of the putter, a set screw is provided through a threaded bore extending forward from the rear of the putter head. In an alternative embodiment of putter designed to comply with tournament play rules preventing the alteration of a club, the inserts can be tightly press fit into a mating slot in the putter head. In addition to the topspin, the angled leg portions of the spring wires can add undesired loft to a golf ball. Therefore, in order to compensate for this tendency, the putter face is angled forward, which minimizes or eliminates the lofting tendency of the putter. A protective molding can be provided surrounding the spring wires to protect them from damage.

OBJECTS AND ADVANTAGES OF THE PRESENT INVENTION

The objects and advantages of the present invention include: providing an improved golf putter; providing such an improved golf putter which simultaneously imparts a forward motion and a topspin motion to a struck golf ball; providing such an improved golf putter which includes a plurality of fine spring wires extending outward and upward from a face of the putter head; providing such a putter in which the spring wires are provided on removably attached interchangeable inserts; providing such an improved golf putter in which an insert is securely held in place within a slot in the putter head, either by set screws or a press fit; providing such a putter which also tends to counteract a tendency of a player to "push" or "pull" his putting stroke; providing such a putter in which different inserts can be tailored with wires extending at different angles to compensate for the tendencies of a particular player to "open" or "close" the putter face during the putting stroke; providing such an improved golf putter with a protective molding surrounding the spring wires; providing such a putter which gives improved true roll of the golf ball by aiding in ball topspin; and providing such an improved putter which is economical to manufacture and which is efficient and convenient in operation, capable of a long operating life and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 1 is a perspective view of a lowermost portion of an improved golf putter in accordance with the present invention, with an insert installed.

FIG. 2 is a perspective view of the lowermost portions of the putter of FIG. 1, with the insert and a securing set screw removed.

FIG. 3 is a cross-sectional view of the putter of FIG. 1, taken along line 3—3 of FIG. 1, and illustrating the orientation of multiple spring wires on a planar surface of the insert.

FIGS. *4a*–*4c* are reduced size front elevational views of three alternative embodiments of putting face inserts, illustrating various angles of the angled leg portions of the spring wires.

FIGS. 5 and 6 are sequential views of a putting stroke with the putter of FIG. 1, illustrating the simultaneous application of topspin and forward motion to a golf ball as imparted by the inventive putter.

FIG. 7 is a perspective, exploded view of a lowermost portion of an alternative embodiment of improved golf putter with a peripheral protective molding surrounding the spring wires of an insert and with the insert and putter head having a press fit.

FIG. 8 is a perspective view of the lowermost portions of the putter of FIG. 7, with the insert installed.

FIG. 9 is a cross-sectional view of the putter of FIG. 8, taken along line 9—9 of FIG. 8, and illustrating the orientation of multiple spring wires on a planar surface of the insert.

FIG. 10 is a greatly enlarged, fragmentary view of the inventive putter striking a golf ball during the putting stroke of FIGS. 5 and 6, illustrating the action of the spring wires as they contact the golf ball.

DETAILED DESCRIPTION OF THE PREFERRED EMBODIMENTS

I. Introduction and Environment

As required, detailed embodiments of the present invention are disclosed herein; however, it is to be understood that the disclosed embodiments are merely exemplary of the invention, which may be embodied in various forms. Therefore, specific structural and functions details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience and reference only and will not be limiting. For example, the words "up", "down", "right" and "left" will refer to directions in the drawings to which reference is made. The words "in" and "out" will refer to directions toward and away from, respectively, the geometric center of the structure being referred to. Said terminology will include the words specifically mentioned derivatives thereof and words of similar import.

Referring to FIG. 1, an improved golf putter in accordance with the present invention is generally indicated at 1. The putter 1 includes a conventional shaft 2. At the bottom end of the shaft 2 is a putter head 4. The putter head 4 includes a front face 5 with a vertically oriented, rectangularly shaped recess 11 formed therein. Referring to FIG. 2, the recess 11 preferably extends less than one half of the way into the head 4 from the front face 5 thereof and includes a peripheral ledge 12 which extends along the sides thereof down to closed off bottom portions 13. A removable putting face insert 14 is shown inserted in the recess 11 in FIG. 1 and removed from the recess 11 in FIG. 2. The putting face insert 14 includes a peripheral slot 15 extending along the sides thereof which slot is sized and positioned to mate with the peripheral ledge 12 in the recess 11. A removable threaded set screw 16 is insertable in a threaded bore 21 extending through a backing portion 22 of the putter head 4. The set screw 16, when it is tightened within the bore 21, contacts a rear surface 23 of the insert 14 to thereby secure the insert 14 in place in the putter head 4. An allen wrench 24 is illustrated in FIG. 2 for tightening the set screw 16, although, of course, the set screw 16 can have a slotted head or a phillips head for accommodating ordinary screw drivers instead. The putter head 4 illustrated in FIGS. 1–3 is better suited as a practice putter since the easily changed configuration as shown with the set screw 16 would probably be illegal in sanctioned tournament play.

FIGS. 7–9 illustrate an alternative embodiment of improved putter, generally indicated at 31. The putter 31 includes a conventional shaft 32. At the bottom end of the shaft 32 is a putter head 34. The putter head 34 includes a front face 35 with a generally horizontally oriented, rectangularly shaped recess 41 formed therein. Referring to FIG. 7, the recess 41 preferably extends less than one half of the way into the head 34 from the front face 35 thereof and includes an upper ledge 42 which is angled inward and upward and a lower ledge 43 which is angled inward and downward. A removable putting face insert 44 is shown inserted in the recess 41 in FIG. 8 and removed from the recess 41 in FIG. 7. The putting face insert 44 includes a rear wedge portion 45 which is somewhat resilient and is sized and positioned to fit within the recess 41 and to mate with the upper and lower ledges 42 and 43 in a press fit arrangement. The wedge portion 45 can be made of a hard rubber-like material, for example. It is contemplated that the press fit arrangement of FIGS. 7–9 would be tight enough that alteration of the club by a golfer on a golf course would be virtually impossible. The putter 31 would thus comply with sanctioned tournament rules. Unlike the insert 14, the insert 44 extends across the entire front face 35 of the putter 31 and otherwise differs from the insert 14 in the provision of a protective molding 46 which surrounds the front surface of the insert 44 for reasons explained below.

Portions of the front surface of the inserts 14 or 44 with variations in the angles of the spring wires, are illustrated in FIGS. 4*a*–4*c*. The various front surfaces in FIGS. 4*a*–4*c* are referenced as 51, 52 and 53, respectively. The functions of the various insert surfaces 51–53 will be explained below.

Referring again to FIGS. 1–3 and 7–10, each insert 14 or 44 has a planar surface 55 which includes a plurality of rows of spring wires 61 attached thereto. Each spring wire 61 includes a substantially horizontal leg portion 62 and an angled leg portion 63. The angled leg portion 63 extends at an angle upward and outward from the horizontal leg portion 62. The planar surface 55 of the insert 14 or 44 resembles a section of a wool card, and, in fact, can be economically cut from such a wool card. The protective molding 46 formed in the insert 44 serves to protect the spring wires 61 from damage due to side impacts such as can be delivered from other clubs in a golf bag, contact with the ground, the sides of a golf cart, etc. The protective molding 46 does not protrude as far outward from the face 55 of the insert 44 as the spring wires 61, and, thus, the angled leg portions 63 of the spring wires 61 are given an unobstructed path to a golf ball during a putting stroke.

Referring again to FIGS. 4*a*–4*c*, a frontal view of alternative insert surfaces 51–53 illustrate just the angled leg portions 63 of the spring wires 61. In FIG. 4*a*, the face 51 includes angled leg portions 63*a* which extend in a plane perpendicular to the planar surface 55. In FIG. 4*b*, the face 52 includes angled leg portions 63*b* which extend in a plane angled to the right of perpendicular to the planar surface 55, as viewed from behind the putter 1. In FIG. 4*c*, the face 53 includes angled leg portions 63*c* which extend in a plane angled to the left of perpendicular to the planar surface 55, again, as viewed from behind the putter 1. The face 51 of FIG. 4*a* is thus designed to impart topspin to a golf ball in a direction perpendicular to the planar surface 55. The face 52 is designed to impart ball topspin with a vector component to the right of perpendicular to the face of the putter 1 to counteract a tendency of a player to close the putter face during the putting stroke (for a right handed player). Finally, the face 53 is designed to impart ball topspin with a vector component to the left of perpendicular to the planar surface 55 to counteract a tendency of a player to open the club face during the putting stroke (again for a right handed player).

Referring to FIGS. 3 and 9, the putter heads 4 and 34 have their front faces 5 and 35, respectively, angled forward from vertical at an angle $\alpha$ to compensate for any loft which would be imparted to a golf ball, such as the ball 71, by the upward angle component of the angled leg portions 63 of the spring wires 61.

Referring to FIGS. 5, 6 and 10, a putting stroke of the putter 1 through a golf ball 71 is illustrated in sequence. At FIG. 5, as the player swings the putter 1 in a normal pendulum motion, the golf ball 71 is first contacted by the angled leg portions 63 of a number of the spring wires 61 in the insert 14. FIG. 10 illustrates the action of the spring wires 61 during contact between the spring wires 61 and the ball 71. In FIG. 10, the spring wires 61 in the area of contact with the ball 71 are illustrated in phantom lines in their original position prior to ball contact, and in solid lines in a deflected position occurring during contract with the ball 71. As the putter 1 is swung through a putting stroke, the angled portions 63 of a number of the spring wires 61 contact a near periphery 72 of the ball 71. This contact forces the spring wires to deflect inward and downward to the solid line position shown in FIG. 10. From this position, the spring wires 61 then spring outward and upward toward their original, phantom line position. This causes the tips of the angled portions 63 to push upward on the near periphery 72 of the ball 71, thus imparting a forward roll or topspin to the ball 71 as it leaves the face 5 of the putter 1, as indicated by the arrow labeled "RELEASE FORCE". This topspin component is provided in addition to the typical forward motion of the golf ball 71 imparted by any putter in the direction of the putting stroke, i.e. normal to the face of the putter 1 as indicated by the arrow labeled "NORMAL REACTION FORCE". The combined effect of the spring release force and the normal reaction force is a vector normal to the face 55 of the putter 1 but positioned above the center of gravity 73 of the ball 71, as indicated by the vector labeled "COMBINED FORCE". The position and direction of this combined vector tends to get the ball 71 rolling as early as possible in its path to the target.

At FIG. 6, the ball 71 has left contact with the putter 1 and is rolling toward the target. As mentioned earlier, by putting topspin on the ball 71 as early as possible in the putting stroke, a player gets a much truer roll over a putting surface. The inertia of the rolling ball helps to overcome the effect of "grain" in the grass on the green, thus minimizing the tendency of the golf ball 71 to follow the grain of the green. The putters 1 and 31 also tend to overcome any tendency of a player to push or pull his stroke off line. In a pulled stroke, the club face is kept perpendicular to the target path, but the putter is swung inside of the target path. In a pushed stroke, the club face is also kept perpendicular to the target path but the putter is swung outside of the target path. It is believed that this is due to a channeling or cushioning effect caused by the spring wires 61 on either side of the impact zone with the golf ball 71. In other words, the cushioning spring wires 61 on either side of the ball impact zone tend to urge the ball 71 in a direction perpendicular to the putter face instead of pulling it or pushing it off line. Again, when the player has a pronounced tendency to close or open the club face, the spring wire configuration of FIGS. 4*b* or 4*c*, respectively, can be used to impart a side vector component to the ball topspin, as explained above.

While FIGS. 5, 6 and 10 have been used to describe a putting stroke of the putter 1, it should be apparent that, with the exception of the protective molding 46, FIGS. 5, 6 and 10 can be used to illustrate a putting stroke with the putter 31 of FIGS. 7–9 as well.

It should be noted that although the putter face inserts 14 and 34 have been shown in a particular shape and orientation, the inserts 14 and 34 can take different shapes and the removable attachment of the inserts 14 and 34 to the club heads 4 and 34, respectively, can be by different means. For example, the insert 14 can be backed with a hook and loop fastener with a mating fastener attached to a front surface of the putter head 4. Furthermore, while the wires 61 can satisfactorily be made of metal, such as steel, they can be fabricated of other materials, including plastic filaments, with satisfactory results. In fact it is possible that the entire inserts 14 and 44, including the spring wires 61, could be made of molded plastic or hard rubber. Furthermore, the illustrated angles of the spring wire leg portions 62 and 63 are merely illustrative. For example, the initial legs 62 can be angled slightly downward instead of substantially horizontal, which would minimize the angle a required to compensate for the angled leg portions 63.

It is thus to be understood that while certain forms of the present invention have been illustrated and described herein, it is not to be limited to the specific forms or arrangement of parts described and shown.

What is claimed and desired to be secured by Letters Patent is as follows:

1. An improved golf putter comprising:

a. a putter head;

b. a plurality of wires attached to said putter head, each said wire including:

i. an initial leg portion extending outward from said putter head; and ii. an angled leg portion extending upward and outward from said initial leg portion, said angled leg portion having a terminal end pointing away from c. said wires being positioned such that at least some of said angled leg portions of said wires contact a golf ball during a putting stroke with said putter.

2. An improved golf putter as in claim 1, wherein said putter head comprises:

a. a removable insert including a planar member with said wires attached thereto.

3. An improved golf putter as in claim 2, and wherein:

a. said angled leg portions of said wires extend in a plane which is generally perpendicular to said planar member.

4. An improved golf putter as in claim 2, and wherein:

a. said angled leg portions of said wires extend in a plane which is to the right of perpendicular to said planar member head when viewed from behind said putter.

5. An improved golf putter as in claim 2, and wherein:

a. said angled leg portions of said wires attached to said insert extend in a plane which is to the left of perpendicular to said planar member when viewed from behind said putter.

6. An improved golf putter as in claim 2, and further comprising:

a. a recess formed in said putter head, said recess forming an opening in a front surface of said putter head; and b. said insert includes a mating portion which is sized and shaped to fit within said recess to thereby attach said insert to said putter head.

7. An improved golf putter as in claim 6, and further comprising a fastener which removably secures said insert within said recess.

8. An improved golf putter as in claim 1, wherein said wires are resilient such that they exhibit a spring effect as said ball is struck.

9. An improved golf putter as in claim 1, and wherein said planar surface extends upward and at an angle forward from vertical from bottom to top to at least partially counteract any lofting effects of the angled leg portions of said wires on said ball.

10. An improved golf putter as in claim 1, and further comprising a protective molding at least partially surrounding said wires.

11. An improved golf putter comprising:

a. a putter head and an insert including a planar surface, said insert being attachable to said putter head;

b. a plurality of wires attached to said planar surface, each said wire including:

i. an initial leg portion extending outward from said planar surface; and ii. an angled leg portion extending upward and outward from said initial leg portion, said angled leg portion having a terminal end pointing away from said putter head; and c. wherein at least some of said angled leg portions of said wires contact a golf ball during a putting stroke with said putter.

12. An improved golf putter as in claim 11, and wherein:

a. said angled leg portions of said wires extend in a plane which is generally perpendicular to said planar surface.

13. An improved golf putter as in claim 11, and wherein:

a. said angled leg portions of said wires extend in a plane which is to the right of perpendicular to said planar surface when viewed from behind said putter.

14. An improved golf putter as in claim 11, and wherein:

a. said angled leg portions of said wires extend in a plane which is to the left of perpendicular to said planar surface when viewed from behind said putter.

15. An improved golf putter as in claim 11, and further comprising:

a. a recess formed in said putter head, said recess forming an opening in a front surface of said putter head; and b. said insert includes a mating portion which is sized and shaped to fit within said recess.

16. An improved golf putter as in claim 15, and further comprising a fastener which removably secures said mating portion of said insert within said recess.

17. An improved golf putter as in claim 16, wherein said wires are resilient such that they exhibit a spring effect as said ball is struck.

18. An improved golf putter as in claim 11, and wherein said planar surface extends upward and at an angle forward from vertical from bottom to top to at least partially counteract any lofting effects of the angle of the angled leg portions of said wires on said ball.

19. An improved golf putter as in claim 11, and further comprising a protective molding at least partially surrounding said wires.

20. An improved golf putter comprising:

a. a putter head with a front surface and with a recess formed in said putter head, said slot forming an opening in said front surface;

b. an insert including a planar surface, said insert including a mating portion which fits within said recess, said planar surface extending upward and at an angle forward with respect to vertical;

c. a plurality of spring wires attached to said planar surface, each said wire including:

i. an initial leg portion extending outward from said planar surface; and ii. an angled leg portion extending upward and outward from said initial leg portion, said angled leg portion having a terminal end pointing away from said putter head; and d. wherein at least some of said angled leg portions of said wires contact a golf ball during a putting stroke with said putter.

21. An improved golf putter as in claim 20, and wherein:

a. said angled leg portions of said wires extend in a plane which is generally perpendicular to said planar surface.

22. An improved golf putter as in claim 20, and wherein:

a. said angled leg portions of said wires extend in a plane which is to the right of perpendicular to said planar surface when viewed from behind said putter.

23. An improved golf putter as in claim 20, and wherein:

a. said angled leg portions of said wires extend in a plane which is to the left of perpendicular to said planar surface when viewed from behind said putter.

24. An improved golf putter as in claim 20, and further comprising a protective molding at least partially surrounding said wires.

* * * * *